US006092595A

United States Patent [19]

Fecht et al.

[11] Patent Number: 6,092,595

[45] Date of Patent: Jul. 25, 2000

[54] DEEP DRILLING AND/OR WELL PUMP SYSTEM USING A HYDRODYNAMIC RETARDER TO COMPENSATE FOR RESTORING TORQUES RELEASED IN THE SYSTEM

[75] Inventors: Andreas Fecht, London, United Kingdom; Heinz Höller; Wolfgang Weber, both of Crailsheim, Germany

[73] Assignee: Voith Turbo GmbH & Co. KG, Heidenheim, Germany

[21] Appl. No.: 08/893,442

[22] Filed: Jul. 11, 1997

[30] Foreign Application Priority Data

Jul. 18, 1996 [DE] Germany ..... 196 28 950

[51] Int. Cl.[7] ..... E21B 43/12; F16D 52/06

[52] U.S. Cl. ..... 166/68; 166/105; 188/296

[58] Field of Search ..... 166/68, 68.5, 105; 188/296; 477/127

[56] References Cited

U.S. PATENT DOCUMENTS

| | | | |
|---|---|---|---|
| 4,043,434 | 8/1977 | Braschler | 188/296 |
| 4,324,387 | 4/1982 | Steinhagen | 254/310 |
| 4,982,819 | 1/1991 | Koshimo | 188/296 |
| 5,193,654 | 3/1993 | Vogelsang | 188/296 |
| 5,358,036 | 10/1994 | Mills | 166/68.5 |
| 5,501,641 | 3/1996 | Koellermeyer et al. | 475/107 |
| 5,551,510 | 9/1996 | Mills | 166/68 |

FOREIGN PATENT DOCUMENTS 27 16 126 10/1977 Germany .

*Primary Examiner*—Frank Tsay

*Attorney, Agent, or Firm*—Marshall, O'Toole, Gerstein, Murray & Borun

[57] ABSTRACT

A deep drilling or deep well pump system includes a driving motor, a driven component connected to the driving motor, and a hydrodynamic retarder. The hydrodynamic retarder includes a rotor and stator blade wheel. The rotor blade wheel and the stator blade wheel together form a toroidal working space continuously filled with a working medium during operation of the deep drilling device or the deep well pump device. The rotor blade wheel is continuously connected at least indirectly to the driving motor. The blading of the rotor and stator blade wheel is designed so that, owing to the blade direction in the drive mode, the rotor blade wheel revolves freely. During the occurrence of restoring forces on the driven components, the retarder operates in a braking manner.

14 Claims, 3 Drawing Sheets

Fig. 3
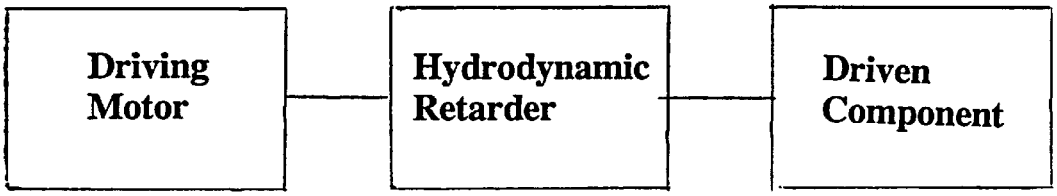
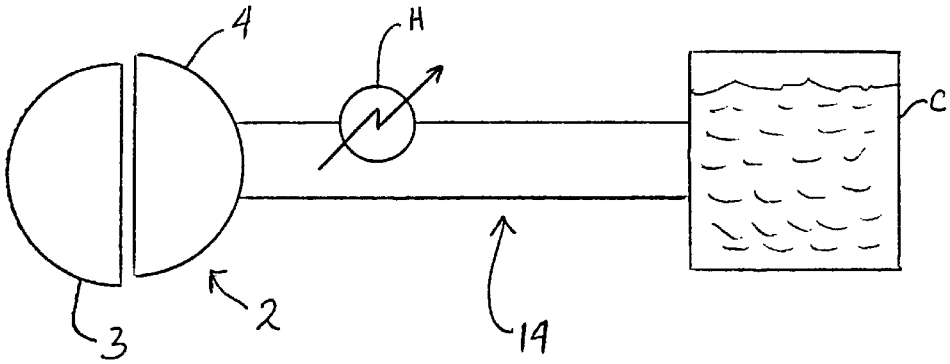
Fig. 4

DEEP DRILLING AND/OR WELL PUMP SYSTEM USING A HYDRODYNAMIC RETARDER TO COMPENSATE FOR RESTORING TORQUES RELEASED IN THE SYSTEM

BACKGROUND OF THE INVENTION

1. Field of the Invention

The invention concerns deep drilling systems and/or well pumping systems and associated apparatus for compensating for restoring torques introduced to a drive string of such a system by the driven end thereof.

2. Description of Related Technology

Several types of deep drilling devices and deep well pump devices are known in the art. A common feature to such devices is that a drive string is coupled to a drilling spindle or to the pump rotor, the string extending over a long distance and being driven by a driving motor. A deep drilling device may be used to prepare a borehole, into which a rotor and stator of a deep well pump device can then be introduced, for example, to pump oil. Owing to the length of the rotating components, e.g., a drive string and rotor, or a drive or drill string and drilling spindle, torsional forces occur in such systems during rotation, which are stored in these components over their length as restoring forces (sometimes identified as reactive forces). During an interruption of power flow from the driving motor to the driven end, for example, when the driving motor is disconnected, or in an emergency, torsion in the peripheral direction and torsional stress on the driven rotating components may lead to the release of a restoring torque through the rotating component, which then acts in the drive, particularly the driving motor and the components connected to it, for example, the connected gears of a driving motor. Such torque release can lead to significant and even irreversible damage, depending on the magnitude of the restoring torque. Such torque release may be particularly damaging if the driving motor is an electric drive motor, which can be driven backwards and thus damaged. Also, drive systems for the most part are not designed for such high, abrupt loads.

To solve these problems, U.S. Pat. No. 5,358,036 discloses a hydraulically operated disk brake device for a deep well pump device, which is disposed between a driving motor and a drive string being driven by the driving motor. The pressure required for activation is produced by a pump device. The pump device is disposed in the drive string so that it is brought into operation as a function of the direction of rotation of the string being driven by its torque and thus activates the brake disk device.

However, devices of the type disclosed in U.S. Pat. No. 5,358,036 are characterized by significant design demands and thus increased cost. The components that accomplish cushioning of the restoring torque and thus the braking effect are also subject to high wear because of mechanical stress.

SUMMARY OF THE INVENTION

It is an object of the invention to overcome one or more of the problems described above. It also is an object of the invention to provide a deep drilling device and a deep well pump device which cost-effectively and with limited design expenditure guards against damage due to the restoring torques that occur during interruption of power flow to the rotating driven parts.

According to the invention, a deep drilling system or a deep well pump system includes a driving motor, a drilling spindle or pump rotor connected to the driving motor, and a hydrodynamic retarder having a rotor blade wheel and a stator blade wheel. The retarder is disposed between the driving motor and the drilling spindle in a deep drilling system and between the driving motor and the pump rotor in a deep well pump system. The retarder compensates for restoring torques on the drilling spindle or pumping rotor occurring during a change in operating state. The rotor blade wheel and the stator blade wheel form a toroidal working space filled with a working medium during operation of the deep drilling system or the deep pump system. The rotor blade wheel is continuously connected to the driving motor. The rotor and stator each have blades which are sloped relative to a plane of separation between the rotor and stator blade wheel. The blades are sloped to a degree to cause the rotor blade wheel to rotate essentially in a freewheeling manner during operation of the drilling spindle or pump rotor. Also, the blades are sloped to a degree to produce a braking torque during occurrence of restoring torques on the drilling spindle or pump rotor, occurring during interruption of power flow from the motor.

Other objects and advantages of the invention will be apparent to those skilled in the art from the following detailed description taken in conjunction with the drawing figures and the appended claims.

BRIEF DESCRIPTION OF THE DRAWINGS

FIG. 3 is a block diagram showing a deep drilling or well pump system according to the invention.

FIG. 4 is a schematic view of a portion of a drive system according to the invention.

DETAILED DESCRIPTION OF THE INVENTION

Figure 1:
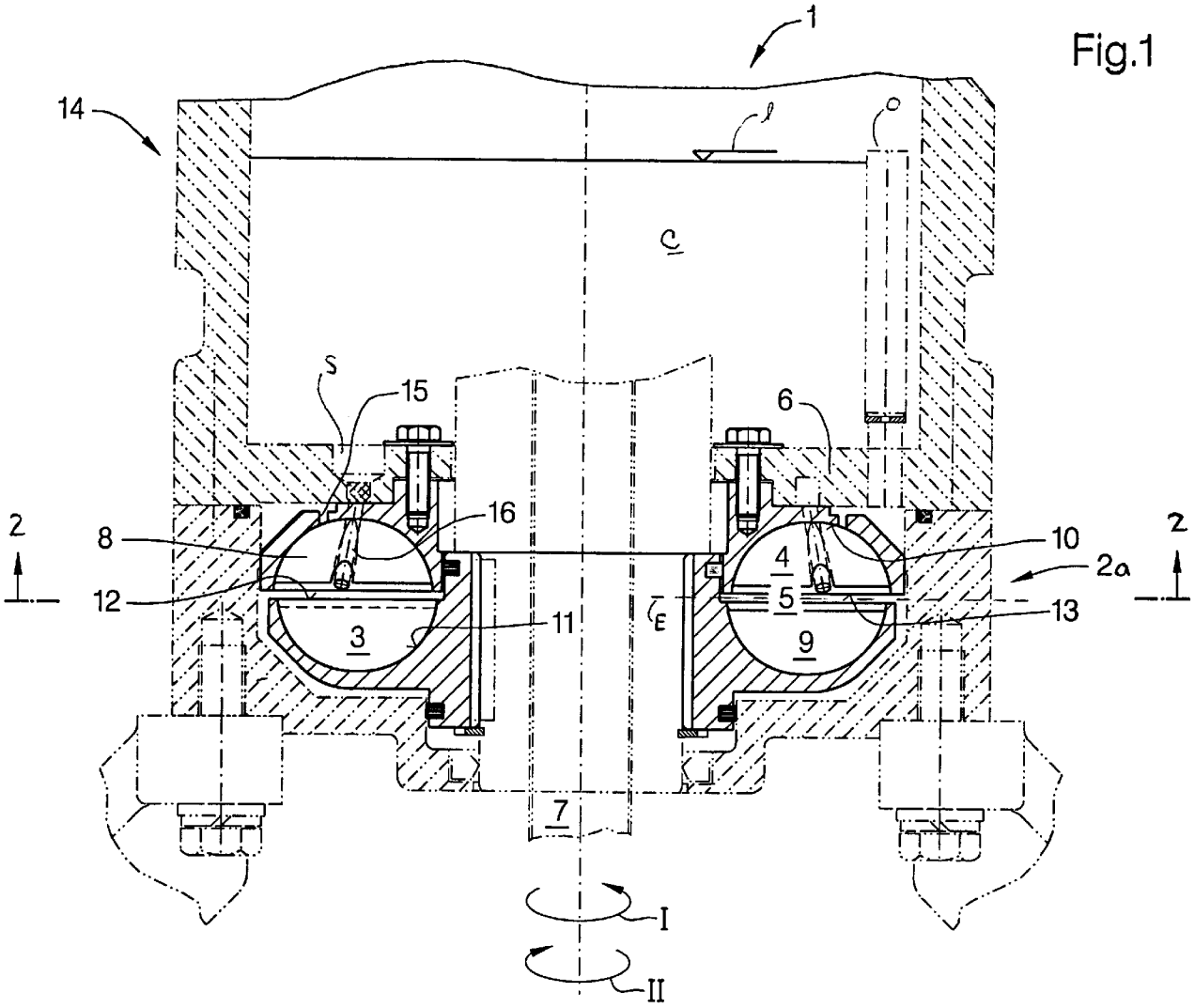
FIG. 1 is a partial cross-sectional view of a drive system according to the invention.

According to the invention, a hydrodynamic retarder is disposed in a deep drilling device between a driving motor and a drive string. Also according to the invention, a hydrodynamic retarder is disposed in a deep well pump device between a driving motor and the pump rotating driven parts, which may extend over a long distance.

A hydrodynamic retarder of the invention includes a rotor blade wheel and a stator blade wheel, which together form a toroidal working space in which the blading is designed obliquely. The retarder is built and fitted into a drive system according to the invention so that during normal operation of the deep drilling or deep well pump device, i.e., during drilling or pumping, the rotor blade wheel operates "centrifugally," i.e., the rotor blade wheel has a freewheeling movement during rotation. When a restoring torque occurs, the rotor blade wheel is slowed or "stuck" against the stator blade wheel, i.e., a torque opposite to the restoring torque is produced. Because of the obliquely designed blading, the rotor blade wheel is permanently connected to the driving motor despite filling of the retarder, and a separate freewheel device to decouple the rotor blade wheel from the drive is not required. Only a limited part of the drive power to drive the rotor blade wheel need be applied by the driving motor itself. The hydrodynamic retarder can therefore remain filled during the entire operation, i.e., external supply and discharge for the filling of the retarder is not necessary during an interruption of power flow. Thus, systems according to the invention are characterized by limited design expenditure and are therefore cost-effective.

A retarder according to the invention preferably operates in self-controlling fashion.

Also according to the invention, a closed circuit for the retarder working fluid may be connected to the toroidal working space between the rotor blade wheel and stator blade wheel. This serves to withdraw any heated working medium from the toroidal working space and feed it back to the hydrodynamic retarder. Outflow from the toroidal working space is made possible via slits in the blade base of the stator blade wheel. Supply of the working medium occurs via corresponding devices in the stator blade wheel. These devices can be designed, for example, as so-called filling slits, which form a filling channel. For this purpose the blading of the stator blade wheel is preferably designed so that the blades carrying filling slits do not run parallel relative to their front and back sides. In particular, starting from the blade base to the blade end, the blades are designed tapered, i.e., from the blade base to the blade end. The blade carrying the filling slit has a thickness in the blade base that makes it possible to integrate the entire filling slit cross-sectionally in the blade. The blade thickness increasingly diminishes from the blade base to the blade end. Only in the region of the filling channel that essentially extends from the blade base to the front edge of the blade does local protrusion or bulging occur on the blade corresponding to the contour or size of the filling slit or filling channel. However, such protrusion remains disposed essentially in the region of the blade end or the front edge of the blade. The number and size of the filling slits, as well as their design, are essentially guided according to the desired time for filling of the retarder loop and the required liquid throughput to withdraw the developed heat. This type of design of the filling channels makes it possible to create undisturbed meridian flow between the rotor and stator blade wheel in the braking operation (identified as the "sticking" operation in the direct translation of the priority document), i.e., during cushioning of the restoring force applied by the drilling spindle or the pump rotor.

Other designs of the filling channels are also conceivable, for example, in the form of filling cams or slits made in a blade thickened over its entire width.

A working medium container may be integrated in the closed loop in a system according to the invention. Such a container may be disposed above the retarder. This permits rapid equalization of any leakage losses by supply to the working space.

Figure 2:
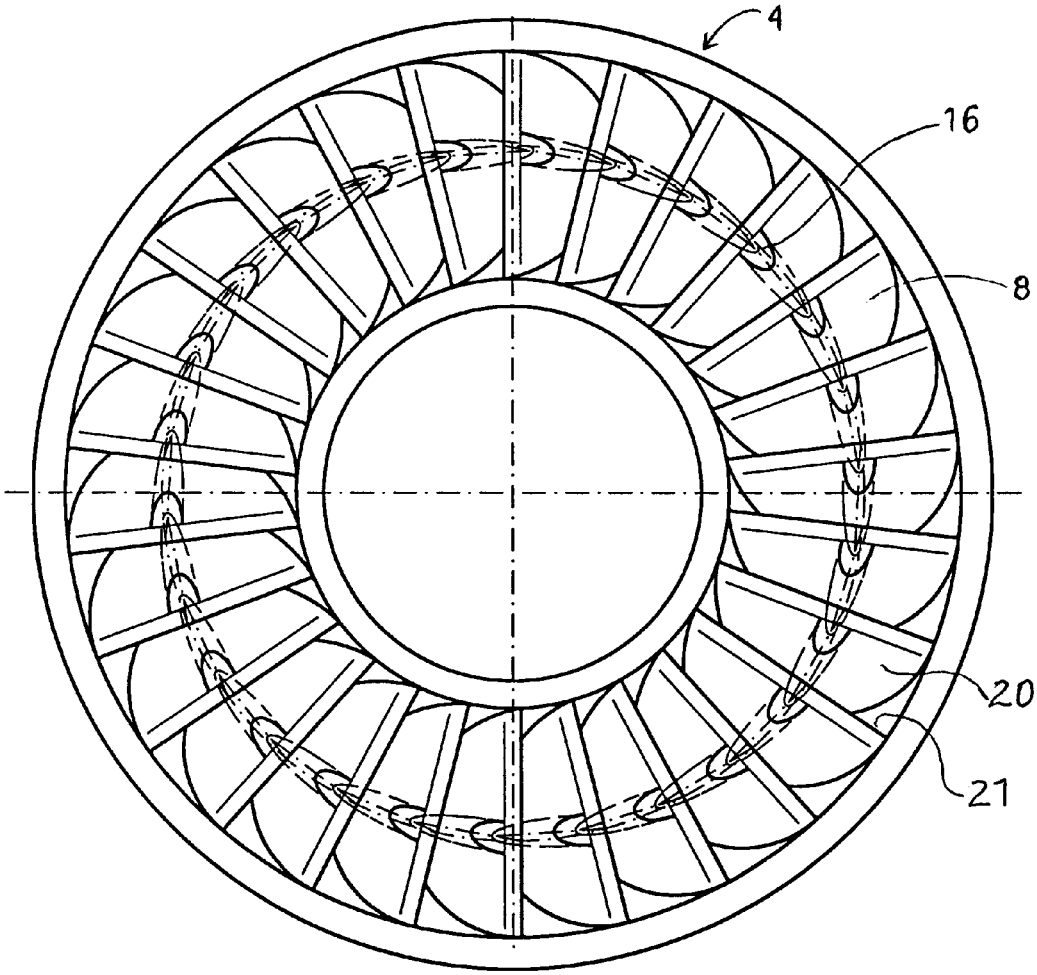
FIG. 2 is a sectional view taken along line 2—2 of FIG. 1.

Apparatus according to the invention are explained further below with reference to drawing figures. FIG. 1 shows a section from a drive system that can be used for either a deep drilling device or a deep well pump device in the fitting position. FIG. 2 shows view 2—2 according to FIG. 1 of a stator blade wheel.

FIG. 1 depicts a section from a drive system 1, as used for a deep drilling device or a deep well pump device. With reference to FIG. 3, a system according to the invention includes a driving motor, a hydrodynamic retarder, and at least one driven component that can be at least rotated by means of the driving motor. The driven component may be: (a) a drilling spindle attached to a drive or drill string for use as a deep drilling device, or (b) a pump rotor, usually attached to a drive string for use as a deep well pump device, which can be designed, for example, as a screw spindle. Generally the drilling spindle and pump rotor are not directly connected to the drive shaft of the driving motor, but rather via a drive or drill string. In such a case, the drive or drill string is also considered as a component of the driven end, i.e., as part of the "driven component" identified in FIG. 3.

According to the invention as shown in FIG. 3, a hydrodynamic retarder 2 is provided between the driving motor and the driven component, i.e., between the driving motor and a drilling spindle or a pump rotor. With reference to FIGS. 1 and 2, the hydrodynamic retarder 2 comprises a rotor blade wheel 3 and a stator blade wheel 4, which together form a toroidal working space 5. The hydrodynamic retarder, especially the stator blade wheel 4, is housed in a housing 6. The rotor blade wheel 3 is continuously connected at least indirectly to the driving motor. The wheel 3 can be coupled to the motor for this purpose to rotate in unison, at least indirectly, with a drive shaft or the driven component. As shown in FIG. 1, the driven component includes a component 7 connected to rotate in unison with a drilling spindle of a drilling device or the pump rotor of a deep well pump device.

The rotor blade wheel 3 and the stator blade wheel 4 have oblique blading 8 and 9, i.e., the blades are arranged sloped relative to a plane of separation E between the rotor blade wheel 3 and the stator blade wheel 4. The blade direction, i.e., the slope of the individual blades relative to a corresponding blade base (identified in FIG. 1 as a blade base 10 for the stator blade wheel 4 and a blade base 11 for the rotor blade wheel 3) toward the corresponding blade end (denoted 12 for the rotor blade wheel 3 and 13 for the stator blade wheel 4) is chosen in the direction of the plane of separation E so that during normal operation, e.g., during driving of the component 7, the rotor blade wheel 3 is continuously carried along, but, because of the oblique blading, a closed loop of working medium cannot form between the rotor and stator blade wheel. The method of operation of the rotor blade wheel 3 in this operating state can be referred to as "centrifugal" relative to the stator blade wheel 4. The working medium remains essentially between the two adjacent blades of blading 9 of the rotor blade wheel 3. No revolution occurs in the direction of the stator blade wheel 4 to the extent that a braking reaction torque is produced. The hydrodynamic retarder 2 therefore operates, in normal operation of the drive system, essentially in a freewheeling manner. In designing drive systems according to the invention, limited required power need only be considered to rotate the rotor blade wheel 3 and thus to circulate the working medium with the rotor blade wheel 3.

During normal operation, the torque of the driving motor is transferred to the rotating driven component— a) to a drilling spindle several hundred meters long in the case of a deep drilling device or b) to a pump rotor also extending over a significant distance in the case of a deep well pump device. Thus, because of the extended length of the driven components, the driven components are exposed to torsion. The torsional forces are stored in the driven components. Torsion of the driven components in the direction of rotation leads to a situation in which these components are exposed to a restoring force when the driving motor is disconnected and release a restoring torque relative to the driving motor. The restoring torque leads to release of torsion, which, depending on the magnitude, can lead to an abrupt load on the driving motor and its connected components.

The rotor blade wheel 3 of the hydrodynamic retarder 2 during recovery of the drilling spindle or the pump rotor is moved opposite the direction of rotation in normal operation because it is connected at least indirectly to rotate in unison with the component 7 which is connected to a drilling spindle or pump rotor. Normal operation (i.e. drilling or pumping) of the system shown in FIG. 2 is identified by an arrow II. An arrow I in the opposite direction of rotation shows a direction or rotation during recovery due to torsional forces. Due to its oblique blading, the hydrodynamic retarder 2 during recovery functions as a hydrodynamic brake, i.e., in the so-called "sticking" operation. A certain braking torque is produced on the stator blade wheel 4 corresponding to the degree of filling and the peripheral velocity in the region of support of the rotor blade wheel 3, which is directed opposite the restoring torque, and thus serves to cushion the restoring torque.

Since the hydrodynamic retarder 2 can be continuously filled owing to the oblique blading thereof and due to the possibility of achieving a freewheeling effect corresponding to the blade direction, the provision of a separate inflow and outflow for normal operation II of the entire drive system is not necessary. During normal operation, i.e., during driving of the drilling spindle or the pump rotor via the driving motor, the working fluid is entrained by the rotor blade wheel 3 and circulated. A so-called working loop between the rotor and stator blade wheel 3 and 4 is only produced in the case of recovery of the drilling spindle or pump rotor due to torsional forces.

A closed loop for the working fluid is connected to the toroidal working space 5 between the rotor and stator blade wheel, which is designated 14 in FIGS. 1 and 4. The closed loop 14 serves to withdraw heated working medium from the toroidal working space 5 and to feed the working fluid directly back to cooling or to pass it through a heat exchanger H and return it to the hydrodynamic retarder 2. FIG. 1 shows a working fluid container C shown filled with a working medium to a certain surface level l, a fluid outlet o, and a fluid supply opening s. The container C may be a high-level tank relative to the built-in position of the retarder. The container C and closed loop 14 also is shown schematically in FIG. 4.

With reference to FIG. 1, output from the toroidal working space is made possible via slits 15 in the blade base 10 of the stator blade wheel 4. Supply of the working medium occurs after cooling via corresponding devices in the stator blade wheel 4. These devices can be designed, for example, as filling slits 16, which form the filling channel. For this purpose, the blading of the stator blade wheel, as shown in FIG. 2, is designed so that the blades carrying the filling slits do not run parallel relative to their front 20 and back sides 21. In particular, starting from the blade base to the blade end, i.e., from the blade base 10 to the blade end 13, the blades are designed tapering. In such an embodiment, the blades carrying the filling slit in the blade base have a thickness that makes it possible to integrate the entire filling slit cross-sectionally in the blade. From the blade base 10 to the blade end 13, here the blade front edge, the blade thickness diminishes increasingly. Only in the region of the filling channel, extending essentially from the blade base 10 to the blade front edge, does a local bulging or protrusion occur on the blade corresponding to the contour or size of the filling slit or filling channel. However, such local bulging or protrusion remains disposed essentially in the region of the blade end or the blade front edge. The number and size of filling slits 16, as well as their design, is guided essentially according to the desired time for filling of the retarder loop and the required liquid throughput to withdraw the developed braking heat. This type of design of the filling channels makes it possible during the braking or so-called "sticking" operation, i.e., during cushioning of the restoring force applied by the drilling spindle, to produce undisturbed meridian flow between the rotor blade wheel and stator blade wheel.

In addition to the advantageous embodiments of the filling slits shown here, it is also conceivable to provide the blading of the stator blade wheel with filling slits so that either just the region of the filling slit from the blade base to the blade end is reinforced or the entire blade carrying the filling slit is designed thickened. The last two possibilities, however, cause the development of turbulence and separation of the stream in the region of the blades designed in this fashion during the braking operation.

A cooling device can be arranged in the closed loop 14, for example, in the form of a heat exchanger H. The closed loop 14, however, can also be designed so that cooling occurs because of its length or because of the interim storage of the working medium. Thus, the closed loop 14 may also be void of an external cooling loop or heat exchanger.

A number of embodiments exist for design and incorporation of the hydrodynamic retarder. It is essential according to the invention, however, to dispose the hydrodynamic retarder in a deep drilling device between the driving motor and drilling spindle, or in a deep well pump device between the driving motor and the pump rotor.

The foregoing detailed description is given for clearness of understanding only, and no unnecessary limitations should be understood therefrom, as modifications within the scope of the invention will be apparent to those skilled in the art.

We claim:

1. A deep drilling system, comprising:

a) a driving motor;

b) a drilling spindle connected to the driving motor;

c) a hydrodynamic retarder having a rotor blade wheel and a stator blade wheel, the retarder being disposed between the driving motor and the drilling spindle to compensate for restoring torques on the drilling spindle occurring during a change in operating state, the rotor blade wheel and the stator blade wheel forming a toroidal working space filled with a working medium during operation of the deep drilling device, the rotor blade wheel being continuously connected to the driving motor, the rotor and stator each having blades sloped relative to a plane of separation between the rotor blade wheel and stator blade wheel, the blades being sloped to a degree to cause the rotor blade wheel to rotate essentially in a freewheeling manner during operation of the drilling spindle, and to produce a braking torque during occurrence of restoring torques on the drilling spindle, occurring during interruption of power flow from the motor.

2. The deep drilling system of claim 1 wherein each of the stator blades comprises a blade base having a slitted opening and further comprising devices for filling of the hydrodynamic retarder with a working medium, the devices for filling being connected to the blades of the stator blade wheel, the slitted openings and the devices for filling being connected to each other via a loop.

3. The deep drilling system of claim 2 wherein the loop is a closed loop.

4. The deep drilling system of claim 2 wherein the loop is void of an external cooling loop.

5. The deep drilling system of claim 2 wherein the loop is a closed loop and is provided with a heat exchanger.

6. The deep drilling system of claim 1 further comprising a filling channel integrated in at least one of the stator blades, the at least one stator blade tapering from a base thereof to a front edge thereof and including local thickening for supporting the filling channel in a region of the blade front edge at a back side of the blade.

7. The deep drilling system of claim 2 further comprising a high-level tank disposed in the loop, said tank being filled with the working medium to a certain level.

8. A deep well pump system, comprising a) a driving motor;

b) a pump rotor connected to the driving motor by a drive string;

c) a hydrodynamic retarder having a rotor blade wheel and a stator blade wheel, the retarder being disposed between the driving motor and the pump rotor to compensate for restoring torques on the pump rotor and drive string occurring during a change in operating state, the rotor blade wheel and the stator blade wheel forming a toroidal working space filled with a working medium during operation of the deep well pump system, the rotor blade wheel being continuously connected to the driving motor, the rotor and stator each having blades sloped relative to a plane of separation between the rotor blade wheel and stator blade wheel, the blades being sloped to a degree to cause the rotor blade wheel to rotate essentially in a freewheeling manner during operation of the pump rotor, and to produce a braking torque during occurrence of restoring torques on the pump rotor and drive string, occurring during interruption of power flow from the motor.

9. The deep well pump system of claim 8 wherein each of the stator blades comprises a blade base having a slitted opening and further comprising devices for filling of the hydrodynamic retarder with a working medium, the devices for filling being connected to the blades of the stator blade wheel, the slitted openings and the devices for filling being connected to each other via a loop.

10. The deep well pump system of claim 9 wherein the loop is a closed loop.

11. The deep well pump system of claim 9 wherein the loop is void of an external cooling loop.

12. The deep well pump system of claim 9 wherein the loop is a closed loop and is provided with a heat exchanger.

13. The deep well pump system of claim 8 further comprising a filling channel integrated in at least one of the stator blades, the at least one stator blade tapering from a base thereof to a front edge thereof and including local thickening for supporting the filling channel in a region of the blade front edge at a back side of the blade.

14. The deep well pump system of claim 9 further comprising a high-level tank disposed in the loop, said tank being filled with the working medium to a certain level.

* * * * *